US006386977B1

(12) United States Patent
Hole

(10) Patent No.: US 6,386,977 B1
(45) Date of Patent: May 14, 2002

(54) FIDUCIARY ELECTRONIC GAME OF CHANCE AND ACCOUNTING SYSTEM

(75) Inventor: Philip D. Hole, Glendale, AZ (US)

(73) Assignee: Dyosan Communications Corporation

( * ) Notice: Subject to any disclaimer, the term of this patent is extended or adjusted under 35 U.S.C. 154(b) by 0 days.

(21) Appl. No.: 08/759,097

(22) Filed: Dec. 3, 1996

(51) Int. Cl.[7] ..... H63F 9/24

(52) U.S. Cl. ..... 463/26; 463/16; 463/25; 463/27

(58) Field of Search ..... 463/16, 17, 18, 463/19, 20, 22, 40, 41, 47, 25, 26, 27, 28

(56) References Cited

U.S. PATENT DOCUMENTS 4,837,728 A * 6/1989 Barrie et al. ..... 463/27
5,344,144 A * 9/1994 Canon ..... 463/27
5,351,970 A * 10/1994 Fioretti ..... 463/19
5,398,932 A * 3/1995 Eberhardt et al. ..... 463/42
5,476,259 A * 12/1995 Weingardt ..... 463/25
5,536,016 A * 7/1996 Thompson ..... 273/269
5,984,779 A * 11/1999 Bridgeman et al. ..... 463/28

* cited by examiner

*Primary Examiner*—Joe H. Cheng
(74) *Attorney, Agent, or Firm*—Gallagher & Kennedy, P.A.; Thomas D. MacBlain

(57) ABSTRACT

A game of chance and associated accounting system better fulfill the fiduciary duty owed to game players and to the public by proprietors of the game of chance. The game of chance and accounting system disinterest the proprietor in the outcome of the game and give a player added incentive to participate in the game. The player is able to monitor continuously the exact amount of the prizes to be won while playing the game.

31 Claims, 2 Drawing Sheets

FIDUCIARY ELECTRONIC GAME OF CHANCE AND ACCOUNTING SYSTEM

FIELD OF THE INVENTION

Figure 1:
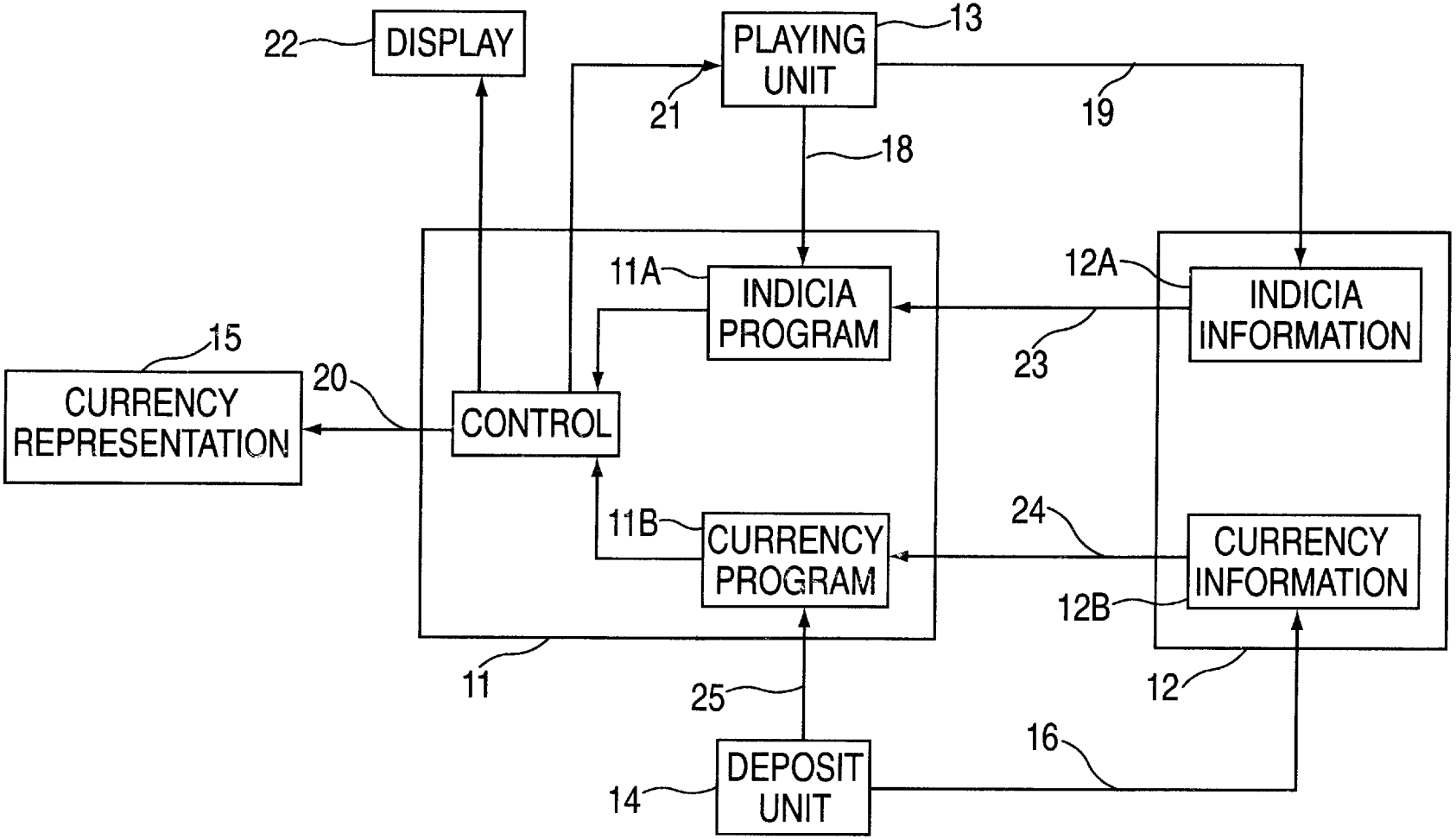

This invention relates to games of chance.

More particularly, the invention relates to a game of chance and associated accounting system which better fulfills the fiduciary duty owed to game players and to the public by proprietors of the game of chance.

BACKGROUND OF THE INVENTION

In another respect, the invention relates to a game of chance and accounting system which disinterests the proprietor in the outcome of the game.

In a further respect, the invention relates to a game of chance and accounting system which gives a player added incentive to participate in a game of chance.

One long standing problem associated with slot machines, electronic poker, keno, and other games of chance found in Las Vegas and other gambling centers is that the proprietor of a gaming establishment has a direct interest in the outcome of the game of chance. More specifically, the proprietors of gaming establishments would prefer that gamblers lose more than they win, otherwise the gaming establishment loses money. Although the odds in most gambling games favor the gaming establishment, the gaming establishment's direct interest in the outcome of a game of chance produces the temptation to adversely influence the outcome of the game and, consequently, the fiduciary duty owed the player by the gaming establishment.

Another long standing fiduciary problem potentially associated with games of chance is the difficulty of accurately counting and monitoring the large cash volumes produced during operation of gaming establishments.

Accordingly, it would be highly desirable to provide an improved game of chance which would eliminate the direct interest of a gaming establishment in the outcome of the game and which would facilitate accounting for the currency generated during the hours of operation of the gambling establishment.

Therefore, it is a principal object of the invention to provide an improved game of chance.

A further object of the invention is to provide an improved game of chance and accounting system which better serves the fiduciary duty owed the players of the game.

Another object of the invention is to provide an improved game of chance which minimizes any interest that a gaming establishment has in the outcome of the game.

Still a further object of the invention is to provide an improved game of chance which enables a player to monitor continuously the exact amount of the prize(s) to be won while playing the game.

Yet another object of the invention is to provide an improved game of chance which facilitates the accurate determination at any given instant of the profit of a gaming establishment from a game of chance played in the gaming establishment.

Yet still a further object of the invention is to provide an improved game of chance and accounting system which generates in a player a feeling of good will toward a gaming establishment.

Figure 2:
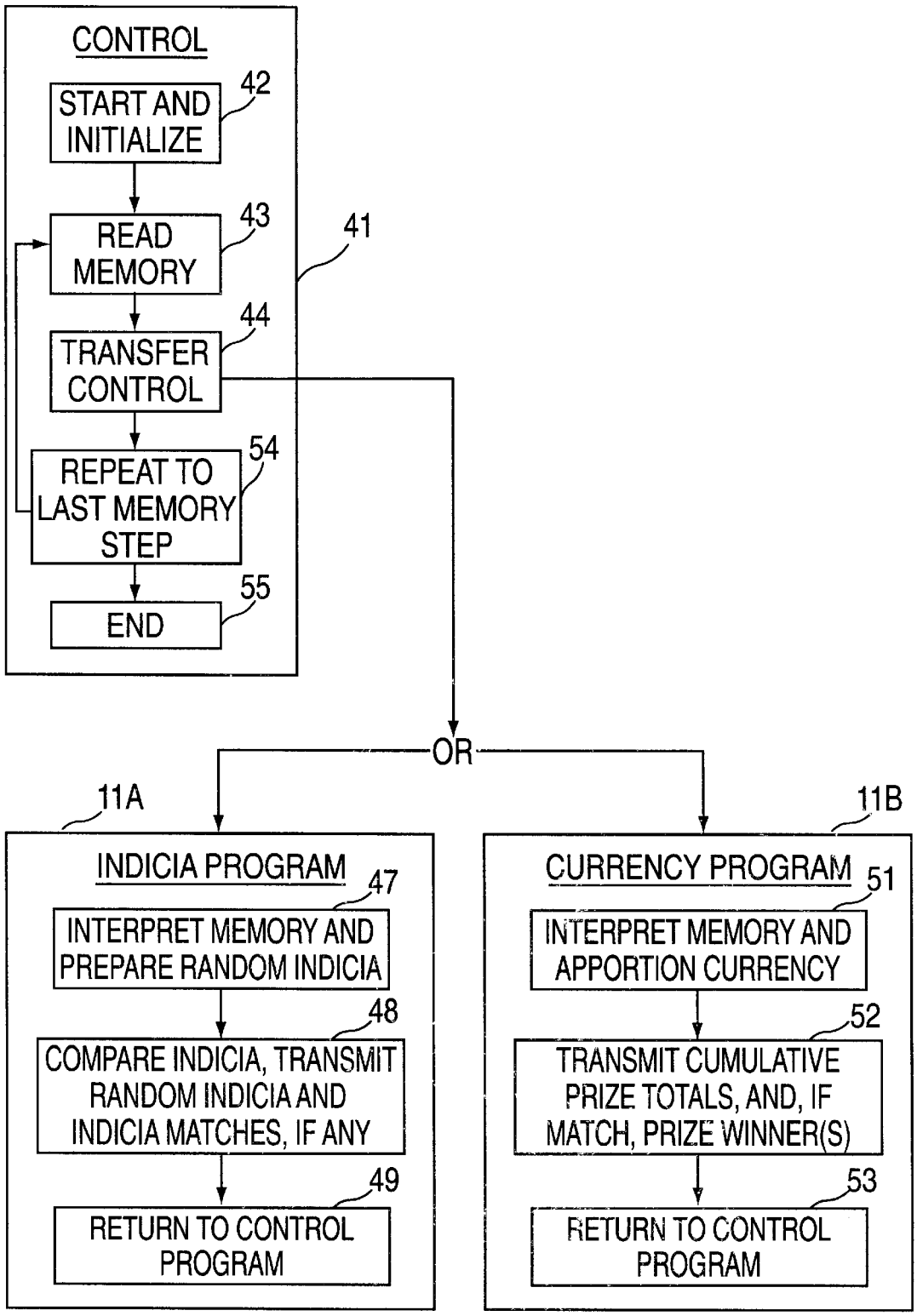

These and other, further and more specific objects and advantages of the invention will be apparent to those skilled in the art from the following detailed description thereof, taken in conjunction with the drawings, in which:

FIG. 1 is a block diagram illustrating an improved game of chance embodying the present invention; and, FIG. 2 is a block diagram which illustrates a typical program or logic function utilized in the game of chance of FIG. 1 in accordance with the invention.

Briefly, in accordance with the invention, I provide an improved fiduciary electronic game of chance and accounting system. The improved game of chance and accounting system include a controller including a system for generating random indicia; a system for generating pre-selected indicia; a system for comparing random indicia to the pre-selected indicia; and, a system for maintaining cumulative totals of currency in at least one prize category. The game of chance also includes a system in communication with the controller for displaying currency totals to a player of the electronic game of chance; and, a plurality of playing machines in communication with the controller. Each of the playing machines includes a deposit unit for receiving currency; a system for, each time currency is deposited in the deposit unit, generating an activation signal indicating when currency is deposited in the deposit unit and indicating the quantity of currency deposited therein; and, a system for transmitting the activation signal to the controller. On receipt of the activation signal, the controller activates the system for generating random indicia to initiate generation of said random indicia. The controller compares the random indicia to the pre-selected indicia to determine the number of matches, if any, between the pre-selected indicia and the random indicia. The controller also directs the system for maintaining cumulative totals of currency to add a pre-determined fraction or proportion of the quantity of currency to at least the one prize category to maintain a cumulative total of the value of currency in the prize category. The prize category is awarded when a selected number of matches occurs between the pre-selected indicia and the random indicia. The cumulative total of the value of currency in the prize category consists only of the pre-determined fraction of all currency deposited in the playing machines prior to the selected number of matches occurring between the pre-selected indicia and the random indicia. The controller also directs the system for maintaining cumulative totals of currency to immediately, after adding the pre-determined fraction of the quantity of currency to the prize category, transmit the cumulative total of the value of currency in the prize category to the currency display system to display the cumulative total of currency.

Turning now to the drawings, which depict the presently preferred embodiment of the invention for the purpose of illustrating the practice thereof and not by way of limitation of the scope of the invention, FIG. 1 illustrates a game of chance and accounting system including a controller and a memory 12. A playing unit 13, display 22, currency representation 15, and deposit unit 14 are also provided. Controller 11 performs the dual function indicated by indicia program 11A and currency program 11B. Indicia information 12A and currency information 12B are stored in memory 12. The currency deposited in unit 14 can comprise hard currency like quarters, dollar bills, etc., can comprise tokens, or can comprise any of a variety of currency credit devices like, for example, credit cards which enable a player to charge a desired quantity of currency.

Playing unit 13 inputs data 18 to indicia program 11A, and data 19 to indicia information 12A in memory 12. Deposit unit 14 inputs 25 data to currency program 11B and inputs 16 data to currency information 12B in memory 12. The data transmitted 18, 19 by playing unit 13 includes any desired information but presently can include—in the form of a signal generated and transmitted by unit 13—indicia pre-selected by the player. For example, if the unit 13 is used to play keno, a player can utilize a keyboard on the unit 13 to select keno numbers. As is well known, in one conventional form of keno, the player selects up to ten numbers from the keno numbers one to eighty (the ten numbers selected by the player being termed "pre-selected indicia" herein) before the game is played. After the player selects up to ten numbers, a machine or an individual randomly selects keno balls out of a queue. The queue holds eighty balls each imprinted with one of the numbers one to eighty. Alternatively, the player can push a button on a keno machine and the machine will randomly pre-select up to ten numbers before the keno game commences. The ten numbers pre-selected, either by the player or randomly by the unit 13, are transmitted 18, 19 to the indicia program 11A and to the indicia information 12A, respectively.

The data transmitted 25, 16 by deposit unit 14 can include any desired information, but presently includes, in the form of an activation signal generated and transmitted by unit 14, the amount of currency deposited in unit 14 by a player (for example, $0.25, $0.50, $1.00, etc.) and the time of day the currency is deposited in unit 14.

The display 22 depicts the pre-selected indicia which will, if matched during the game, win the game of chance being played. For example, when unit 13 is a slot machine, display 22 may state that a prize will be paid for a three sevens indicia match, three cherries indicia match, two sevens and one cherry indicia match, two cherries and one seven indicia match, etc. In the case of a slot machine, the winning matches or combinations are ordinarily pre-selected by the gaming establishment. Of, if unit 13 is utilized to play keno, then display 22 may state that winning matches include a ten number match (where all ten numbers pre-selected by the player or randomly by the unit 13 are matched by ten of the ten numbers randomly picked by the gaming establishment or by unit 13), nine number match (where only nine of the pre-selected numbers match with nine of the ten numbers picked by the gaming establishment or by unit 13), eight number match, seven number match, etc. In the case of keno, the display 22 can also depict the numbers pre-selected by the player before the keno game begins. In the case of poker, the display 22 can depict the cards held by the player as the poker hand progresses.

Currency representation 15 continuously indicates the prizes awarded when a player has a winning match. Representation 15 is normally (but need not be) utilized in conjunction with and is an integral part of display 22. For example, if unit 13 is a slot machine, currency representation and display 22 could comprise:

Three sevens pays $1,540.15

Three cherries pays $650.45

Two sevens and one cherry pays $150.65

Two cherries and one seven pays $60.85

The dollar amounts utilized in conjunction with "Three sevens pays" and "Three cherries pays" comprise the currency representation 15.

In the practice of the invention, the player continuously instantaneously knows the cumulative prize to be awarded for a particular indicia match. Each time the player deposits currency in unit 14, the currency program 11B assigns to each indicia match or prize category a set proportion of the currency deposited and the currency representation 15 for each indicia match is immediately incremented to display a new larger total which is viewed by the player. Each time the player deposits currency in unit 14, the currency program 11B also assigns a fixed proportion of the deposited currency as profit or "take" by the gaming establishment. Cumulative totals of currency in each prize category and in the take by the gaming establishment are automatically calculated and maintained. Currency representation 15 and display 22 can be seen, heard, touched, and/or otherwise sensed by and displayed to a player operating a unit 13 so that the player is continuously aware of the changing cumulative amounts of currency in each prize category.

The indicia information 12A presently includes pre-selected indicia and randomly selected indicia.

The pre-selected indicia consist of indicia which if matched during the game will win a prize. The pre-selected indicia can, in some games, be determined by the gaming establishment and not the player before a game is played, as in the case of a slot machine where the gaming establishment determines that the player wins when three sevens, three cherries, etc. appear on the slot machine. Similarly, in poker the pre-selected indicia ordinarily are determined by the gaming establishment and comprise, for example, a royal flush, four of a kind, full house, etc. However, the pre-selected indicia can also, in some games, be determined by the player, as in the case of a keno game where the player is permitted to select up to ten numbers.

The randomly selected indicia are randomly determined while the game is played. The randomly selected indicia can be automatically generated during the play of the game or can be generated by an employee of the gaming establishment. The employee of the gaming establishment can generate the randomly selected indicia by utilizing electronic software or equipment, or by simply randomly selecting indicia out of a queue or other indicia source. Keno numbers can, for example, be randomly selected by an employee by randomly selecting numbered balls out of a hopper of eighty balls each bearing a different number from one to eighty. On the other hand, software programs or mechanical mechanisms for automatically generating random indicia for slot machines and other games of chance are well known in the art.

The currency information 12B presently comprises cumulative totals of the currency prizes awarded for winning indicia matches which occur during a game(s) of chance, comprises a cumulative total of the currency retained as "take" by the gaming establishment, comprises the cumulative total of all currency deposited by players during a game(s), comprises the time of day each currency deposit is made by a player, and comprises the mathematical algorithms for calculating, tracking, and updating the cumulative prize totals and the cumulative total of currency retained by the house.

Other data input means (a keyboard, punched card reader, paper tape reader, optical scanner, etc.) and data output means (a printer, visual display etc.) can, if desired, be utilized in conjunction with controller 11.

Playing unit 13 typically comprises a housing and other components necessary to play a game of chance. For example, in a slot machine, unit 13 includes a housing and an arm which is pulled by a player after an appropriate amount of currency is deposited in unit 14. The display 22, deposit unit 14, and currency representation 15 can, if desired, be incorporated in playing unit 13. In a poker machine, unit 13 can include a unit 14, a screen showing the poker hand held by the player during the game, and buttons or other means for operating unit 13 to take and discard the number of cards desired by the player during each phase of the game. Controller 11 and memory 12 can be incorporated in unit 13 or can be remote from and in communication with a unit 13. A plurality of units 13 are normally connected to controller 11, and each unit 13 normally includes its own deposit unit 14, display 22, and currency representation 15.

The controller 11 can be a digital computer, analog computer, hybrid computer, or other programmable apparatus. In practice, the very large majority of computers comprise digital computers.

The memory 12 can be any suitable prior art memory unit such as are commonly used in digital or other computers. For example, electromagnetic memories such as magnetic, optical, solid state, etc. or mechanical memories such as paper tape.

FIG. 2 is a block flow diagram which illustrates a typical program or logic function which is executed by the controller 11. The basic control program 41 consists of commands to "start and initialize" 42, "read memory" 43 and "transfer control" 44 to either the indicia program sub-routine 11A or the currency program sub-routine 11B.

The indicia program sub-routine 11A consists of commands to "interpret memory and prepare random indicia" 47, "compare (pre-selected and random) indicia, transmit random indicia and indicia matches, if any" 48, and "return to control program" 49. The currency program 11B consists of commands to "interpret memory and apportion currency" 51, "transmit cumulative prize totals, and, if there is a match, transmit the prize winner(s)" 52, followed by "return to control program" 53. The control program 41, indicia program 11A and currency program 11B subroutines are repeated as indicated by the "repeat to last memory step" 54 of the control program 41 followed by an "end" program step 55 which completes the execution of the program.

The following example describes use of the invention in conjunction with a slot machine.

EXAMPLE

A plurality of playing units 13 are provided, each connected to a controller 11 and memory 12. Each unit 13 is a slot machine including a deposit unit 14, display 22, and currency representation 15. Each unit 13 includes a window which enables a player to view the three indicia which appear during operation of the slot machine. The indicia can appear mechanically or on a television or CRT screen.

To operate a unit 13, a player inserts a dollar and pulls the handle on the slot machine. Three indicia then appear in the window of the slot machine. The indicia can be the numbers one to nine, cherries, or stars.

The display 22 identifies the pre-selected indicia or prize categories which will win the game. At the beginning of the game, before players have deposited any money in the playing units 13, display 22 reads:

| | |
|---|---|
| First Game: | Three sevens pays: |
| | Three cherries pays: |
| Second Game: | Three sevens pays: |
| | Three cherries pays: |
| | Two sevens and one cherry pays: |

The currency representation 15 functions to post cumulative prize amounts adjacent each line on display 22 while the slot machines are utilized. These amounts are:

$0.00

$0.00

$0.00

$0.00

$0.00

Before the slot machines are utilized for the first time, each prize amount in currency representation 15 ordinarily must be zero because the gaming establishment cannot front the game. Consequently, before the slot machines are utilized for the first time, display 22 in combination with currency representation 15 reads:

| | | |
|---|---|---|
| First Game: | Three sevens pays: | $0.00 |
| | Three cherries pays: | $0.00 |
| Second Game: | Three sevens pays: | $0.00 |
| | Three cherries pays: | $0.00 |
| | Two sevens and one cherry pays: | $0.00 |

As noted on display 22, the controller 11 functions to play two (or more) games simultaneously (controller 11 can also play only a single game at a time).

If a player wishes to play only the first game, he inserts only one dollar in deposit unit 14 and pulls the lever once on the slot machine. Three indicia appear in the window of the slot machine.

If the player wishes to play both games, he inserts two dollars in the unit 13, pulls the lever once, and views the three indicia which appear in the window of unit 13. The three indicia which appear in the window are, as will be described, utilized in playing both games.

The initial "cumulative" prize amounts noted above as appearing on currency representation 15 before the slot machines are first used are, as noted, zero because the gaming establishment can not front the game. However, as will be seen, after the slot machines are utilized for a period of time, the prize amounts depicted by currency representation 15 will incrementally increase each time currency is deposited in a unit 14. When a player wins a prize category in a game by, for example, having three sevens appear on his unit 13, the player is paid the amount of currency showing on currency representation 15 for the winning prize category. When the player is paid, the currency amount showing on currency representation 15 adjacent the winning prize category could go to zero. Instead, in the practice of the invention, an initial new prize amount greater than zero is displayed on currency representation 15 so that players will have more incentive to continue playing the game. Each initial prize amount displayed on currency representation 15 immediately after a player wins a prize category is, as will be described, taken from and offset by currency inserted in units 14 during game play.

As soon as a player inserts currency in a deposit unit 14 associated with a playing unit 13, deposit unit 14 generates an activation signal indicating the time of day the currency is deposited and the quantity of currency deposited. This activation signal is transmitted by unit 14 to controller 11. If the amount of the currency deposited is not sufficient to play a game, the controller sends a message to unit 13 asking the player to deposit-additional currency. If the amount of the currency deposited is sufficient to play a game, then controller 11 via indicia program 11A generates random indicia. Various means, electronic and otherwise, for generating random indicia are well known in the art and will not be detailed herein. Program 11A compares the random indicia with the pre-selected indicia shown in display 22 and transmits the random indicia to unit 13 so that the random indicia will appear on the screen of unit 13 when the player pulls the lever on unit 13. If there is a match between the random indicia and the pre-selected indicia (i.e., if for example the random indicia comprise three sevens and the pre-selected indicia in a prize category comprise three sevens), then controller 11 commands unit 13 to dispense to the player an amount equal to that appearing on currency representation 15 for that particular indicia match. Alternatively, controller 11 can audibly or visually notify an employee of the gaming establishment that there has been a winner so that the employee can pay the player at the unit 13 where the particular indicia match occurred. Each time controller 11 receives an activation signal from a unit 14 and the amount of currency indicated by the activation signal is sufficient (i.e., $1.00) to play the First Game, the currency program 11B apportions the currency deposited for the First Game as follows:

| | | |
|---|---|---|
| First Game: | Three sevens win: | 75% |
| | Three cherries win: | 15% |
| | Gaming establishment: | 5% |
| | Three sevens initial prize amount: | 4% |
| | Three cherries initial prize amount: | 1% |

If a player deposits two dollars in unit 14, then the player is playing the First and Second Games simultaneously. Program 11B apportions the $1.00 in currency deposited for the Second Game as follows:

| | | |
|---|---|---|
| Second Game: | Three sevens win: | 60% |
| | Three cherries win: | 20% |
| | Two sevens and one cherry win: | 10% |
| | Gaming establishment: | 5% |
| | Three sevens initial prize amount: | 3% |
| | Three cherries initial prize amount: | 1% |
| | Two sevens and one cherry initial prize amount: | 1% |

Each time controller 11 apportions $1.00 deposited in a unit 14, controller 11 immediately adds the apportioned amounts to the existing win cumulative prize totals shown in currency representation 15 and to the initial prize cumulative totals, and then causes the new cumulative win prize totals to be displayed on currency representation 15. By way of example, when the first dollar is inserted in a unit 14 to play the First Game, the currency program 11B assigns $0.75 to the win prize for the three sevens indicia match in the First Game, $0.15 to the win prize for the three cherries indicia match in the First Game, $0.05 to the gaming establishment, $0.04 to the three sevens initial prize amount, and $0.01 to the three cherries initial prize amount. Controller 11 then updates currency representation 15 for the First Game to read:

| | | |
|---|---|---|
| First Game: | Three sevens pays: | $0.75 |
| | Three cherries pays: | $0.15 |

After the second dollar for the First Game is inserted in any one of units 14 and is apportioned by controller 11, currency representation 15 for the First Game reads:

| | | |
|---|---|---|
| First Game: | Three sevens pays: | $1.50 |
| | Three cherries pays: | $0.30 |

And so on.

When the first dollar is inserted in a unit 14 to play the Second Game, the currency program 11B apportions $0.60 to the win prize for the three sevens indicia match in the Second Game, $0.20 to the win prize for the three cherries indicia match in the Second Game, $0.10 to the win prize for the two sevens and one cherry indicia match in the Second Game, $0.05 to the gaming establishment, $0.03 to the three sevens initial prize amount in the Second Game, $0.01 to the three cherries initial prize amount in the Second Game, and $0.01 to the two sevens and one cherry initial prize amount in the Second Game. Each time currency is apportioned to prize categories for particular indicia matches by program 11B, program 11B adds each apportioned amount to the appropriate, pre-existing amount (if any) of currency in a win prize category or in an initial prize amount category to arrive at a new cumulative currency total for each prize category. Similarly, each time currency is apportioned to the gaming establishment, program 11B adds the amount apportioned to the pre-existing amount (if any) of currency assigned to the gaming establishment to arrive at a new cumulative currency total for the gaming establishment. After the first dollar is inserted in a unit 14 for the Second Game, controller 11 updates currency representation 15 for the Second Game to read:

| | | |
|---|---|---|
| Second Game: | Three sevens pays: | $0.60 |
| | Three cherries pays: | $0.20 |
| | Two sevens and one cherry pays: | $0.10 |

After the second dollar for the Second Game is inserted in any one of units 14, currency representation 15 for the Second Game reads:

| | | |
|---|---|---|
| Second Game: | Three sevens pays: | $1.20 |
| | Three cherries pays: | $0.40 |
| | Two sevens and one cherry pays: | $0.20 |

And so on.

During play of a game, the controller 11 continuously maintains cumulative totals of the currency in win prize categories (like the three sevens category, the three cherries category, etc.), maintains cumulative totals of the currency in the initial prize amount categories, maintains a record of all prizes paid to players, maintains a cumulative total of the amount of money (the "take") made by the gaming establishment, and maintains a cumulative total of the amount of money deposited in units 14. When $1.00 in currency is deposited in a unit 14 to play the First Game or Second Game, controller 11 also immediately posts on currency representation 15 for viewing by the player the new cumulative currency total for each win prize category. It is also preferred that the total amount of money deposited in units 14, the prizes paid, and the total amount of money made by the gaming establishment (the gaming establishment's "take") be continuously or periodically displayed at a location frequented only by employees of the gaming establishment and not by players. All money awarded as prizes for the First Game and Second Game, and all money retained by the gaming establishment as its "take" comes from currency deposited in units 14 by the game players. These accounting procedures are believed effective in minimizing or negating any interest the gaming establishment has in the outcome of the game(s) of chance. The continuous instantaneous display on currency representation 15 of the cumulative increasing currency amount in each win prize category is also believed critical in helping to entice individuals into playing the game(s) of chance.

After players have been inserting currency in units 14 for nearly an hour, there have not been any winners. However, the last player to deposit a dollar in a unit 14 at the end of the first hour of the game has three sevens appear on the screen in his unit 13. When the three sevens appear on the screen, the player has won the currency in the win prize category for an indicia match of three sevens in the First Game. After the last player deposits his dollar in a unit 14, $6,242.00 has been deposited in units 14 for the First Game during the first hour of play, $4,438.00 has been deposited in units 14 for the Second Game during the first hour of play, and display 22 and currency representation 15 read:

| | | |
|---|---|---|
| First Game: | Three sevens pays: | $4681.50 |
| | Three cherries pays: | $936.30 |
| Second Game: | Three sevens pays: | $2662.80 |
| | Three cherries pays: | $887.60 |
| | Two sevens and one cherry pays: | $443.80 |

The cumulative amount of $312.10 (5% of total amount bet for First Game) is apportioned to the gaming establishment for the First Game. The cumulative amount of $221.90 (5% of the total amount bet for the Second Game) is apportioned to the gaming establishment for the Second Game. The total cumulative amount incrementally apportioned by the controller 11 to the gaming establishment during the first hour the First Game and Second Game are played on units 13 is therefore $534.00.

The $4681.50 cumulative amount shown in the three sevens win prize category for the First Game equals [$6242.00×0.75]. This cumulative amount is incrementally apportioned by controller 11 to the three sevens win prize category during the first hour the First Game is played.

The $936.30 cumulative amount shown in the three cherries win prize category for the First Game equals [$6242.00×0.15]. This cumulative amount is incrementally apportioned by controller 11 to the three cherries win prize category during the first hour the First Game is played.

The $2662.80 cumulative amount shown in the three sevens win prize category for the Second Game equals [$4438.00×0.60]. This cumulative amount is incrementally apportioned by controller 11 to the three sevens win prize category during the first hour the Second Game is played simultaneously with the First Game.

The $887.60 cumulative amount shown in the three cherries win prize category for the Second Game equals [$4438.00×0.20]. This cumulative amount is incrementally apportioned to the three cherries win prize category during the first hour the Second Game is played concurrently with the First Game.

The $443.80 cumulative amount shown in the two sevens and one cherry win prize category for the Second Game equals [$4438.00×0.10]. This cumulative amount is incrementally apportions to the two sevens and one cherry win prize category during the first hour the Second game is played concurrently with the First Game.

The total cumulative amount of $249.68 (4% of the total amount bet for the First Game during the first hour) is incrementally apportioned by controller 11 to the initial prize amount for the three sevens in the First Game.

The total cumulative amount of $62.42 (1 % of the total amount bet for the First Game during the first hour) is incrementally apportioned by controller 11 to the initial prize amount for the three cherries in the First Game.

The total cumulative amount of $133.14 (3 % of the total amount bet for the Second Game during the first hour) is incrementally apportioned by the controller 11 to the initial prize amount for the three sevens in the Second Game.

The total cumulative amount of $44.38 (1 % of the total amount bet for the Second Game during the first hour) is incrementally apportioned by controller 11 to the initial prize amount for the three cherries in the Second Game.

The total cumulative amount of $44.38 (1 % of the total amount bet for the Second Game during the first hour) is incrementally apportioned by controller 11 to the initial prize amount for the two sevens and one cherry in the Second Game.

A casino employee pays the $4681.50 prize noted on the currency representation 15 to the player who had three sevens appear on his screen at the end of the first hour the games were played.

Immediately after the player wins the $4681.50 prize, controller 11 assigns the initial prize amount of $249.68 to the three sevens category of the First Game and display 22 and currency representation 15 read as follows:

| | | |
|---|---|---|
| First Game: | Three sevens pays: | $249.68 |
| | Three cherries pays: | $936.30 |
| Second Game: | Three sevens pays: | $2662.80 |
| | Three cherries pays: | $887.60 |
| | Two sevens and one cherry pays: | $443.80 |

Players continue to insert currency in units 14 for the second hour of the game. After the second hour of playing the games is nearly over, there have not been any winners other than the player who won the $4681.50 prize at the end of the first hour of the games. However, the last player to deposit currency in a unit 14 during the second hour of the games wins the Second Game. The player deposits two dollars in a unit and, when he pulls the lever on his unit 13, three sevens appear on the screen in his unit 13. After the last player deposits his two dollars in a unit 14, an additional $12, 440.00 has been deposited in units 14 for the First Game, an additional $10,468.00 has been deposited in units 14 for the Second Game, and at the end of the second hour display 22 and currency representation 15 read:

| | | |
|---|---|---|
| First Game: | Three sevens pays: | $9579.68 |
| | Three cherries pays: | $2802.30 |
| Second Game: | Three sevens pays: | $8943.60 |
| | Three cherries pays: | $2981.20 |
| | Two sevens and one cherry pays: | $1490.60 |

During the second hour the games are played, the cumulative amount of $622.00 (5% of total amount bet for First Game during the second hour the First Game is played) is incrementally apportioned by controller 11 to the gaming establishment for the First Game. In addition, during the second hour the games are played, the cumulative amount of $523.40 (5% of the total amount bet for the Second Game during the second hour the Second Game is played) is incrementally apportioned by controller 11 to the gaming apportioned by controller 11 to the gaming establishment during the second hour the games are played is therefore $1145.40. The total cumulative amount apportioned to the gaming establishment by controller 11 during the first and second hours the games are played is therefore $1145.40 plus $534.00 or $1679.40.

The $9579.68 cumulative amount shown in the three sevens win prize category for the First Game equals the $249.68 remaining in that win prize category after the first hour the First Game is played plus the amount of [$12,440.00×0.75] representing currency incrementally apportioned by controller 11 to that win prize category during the second hour the First Game is played.

The $2802.30 cumulative amount shown in the three cherries win prize category for the First Game equals the $936.30 amount remaining in that win prize category after the first hour the First Game is played plus the amount of [$12,440.00×0.15] representing currency incrementally apportioned by controller 11 to that win prize category during the second hour the First Game is played.

The $8943.60 cumulative amount shown in the three sevens win prize category for the Second Game equals the $2662.80 amount remaining in that win prize category after the first hour the Second Game is played plus the amount of [$10,468.00×0.60] representing currency incrementally apportioned by controller 11 to that win prize category during the second hour the Second Game is played. As noted, the First and Second games are played concurrently.

The $2981.20 cumulative amount shown in the three cherries win prize category for the Second Game equals the $887.60 amount remaining in that win prize category after the first hour the Second Game is played plus the amount of [$10,468.00×0.20] representing currency incrementally apportioned by controller 11 to that win prize category during the second hour the Second Game is played.

The $1490.60 cumulative amount shown in the two sevens and one cherry win prize category for the Second Game equals the $443.80 amount remaining in that win prize category after the first hour the Second Game is played plus the amount of [$10,468.00 ×0.10] representing currency incrementally apportioned to that win prize category by controller 11 during the second hour the Second Game is played.

During the second hour the games are played, the total cumulative amount of $497.60 (4% of the total amount bet for the First Game during the second hour) is incrementally apportioned by controller 11 to the initial prize amount for the three sevens in the First Game.

During the second hour the games are played, the total cumulative amount of $124.40 (1% of the total amount bet for the First Game during the second hour) is incrementally apportioned by controller 11 to the initial prize amount for the three cherries in the First Game. By the end of the second hour, the total cumulative amount apportioned to the initial prize amount for the three cherries in the First Game equals the $62.42 remaining after the first hour plus $124.40 apportioned during the second hour for a total of $186.82.

During the second hour the games are played, the total cumulative amount of $314.04 (3% of the total amount bet for the Second Game during the second hour) is incrementally apportioned by controller 11 to the initial prize amount for the three sevens in the Second Game. By the end of the second hour, the total cumulative amount apportioned to the initial prize amount for the three sevens in the Second Game equals the $133.14 remaining after the first hour plus $314.04 apportioned during the second hour for a total of $447.18.

During the second hour the games are played, the total cumulative amount of $104.68 (1% of the total amount bet for the Second Game during the second hour) is incrementally apportioned to the initial prize amount for the three cherries in the Second Game. By the end of the second hour, the total cumulative amount apportioned to the initial prize amount for the three cherries in the Second Game equals the $44.38 remaining after the first hour plus the $104.68 apportioned during the second hour for a total of $149.06.

During the second hour the games are played, the total cumulative amount of $104.68 (1% of the total amount bet for the Second Game during the second hour) is incrementally apportioned by controller 11 to the initial prize amount for the two sevens and one cherry in the Second Game. By the end of the second hour, the total cumulative amount apportioned to the initial prize amount for the two sevens and one cherry in the Second Game equals the $44.38 remaining after the first hour plus the $104.68 apportioned during the second hour for a total of $149.06.

A casino employee pays both the $9579.68 prize (for the First Game) and the $8892.60 prize (for the Second Game) to the player who had three sevens appear on his screen at the end of the second hour of play of the games.

Immediately after the player wins the $9579.68 and $8892.80 prizes, display 22 and currency representation 15 read as follows:

| | | |
|---|---|---|
| First Game: | Three sevens pays: | $497.60 |
| | Three cherries pays: | $2802.30 |
| Second Game: | Three sevens pays: | $447.18 |
| | Three cherries pays: | $2981.20 |
| | Two sevens and one cherry pays: | $1490.60 |

The game continues in the manner described above.

Having described my invention in such terms as to enable those skilled in the art to make and use it, and having described the presently preferred embodiments thereof, I claim:

1. A fiduciary electronic game of chance and accounting system including:

(a) controller means including:
- (i) random indicia means for generating random indicia;
- (ii) preselected indicia means for generating preselected indicia;
- (iii) means for comparing random indicia to said preselected indicia to determine the matches, if any, between said preselected indicia and said random indicia;
- (iv) currency control means for maintaining cumulative totals of currency in at least one prize category;

(b) representation means in communication with said controller means for displaying cumulative currency totals to a player of the electronic game of chance; and (c) a plurality of playing means in communication with said controller means and each including:
- (i) deposit means for receiving currency,
- (ii) means for, each time currency is deposited in said deposit means, indicating when currency is deposited in said deposit means and indicating the quantity of currency deposited therein,
- (iii) means for signaling said controller means to:
  - activate said random indicia means to initiate generation of said random indicia,
  - compare said random indicia to said preselected indicia to determine the number of matches, if any, between said preselected indicia and said random indicia,
  - direct said currency control means
    - add a first predetermined fraction of said quantity of currency to at least said prize category to maintain a cumulative total of the value of currency in said prize category, said prize category being awarded when a selected number of matches occurs between said preselected indicia and said random indicia, said cumulative total of the value of currency in said prize category consisting only of said predetermined fraction of all currency deposited in said playing means prior to said selected number of matches occurring between said preselected indicia and said random indicia and said currency control means allocating a further predetermined fraction of said quantity of currency to a fee category for retention by a game proprietor, and said controller means, immediately after adding said predetermined fraction of said quantity of currency to said prize category to obtain the cumulative total of the value of currency in said prize category, transmitting the cumulative total of the value of currency in said prize category to said representation means to display the cumulative total of the value of currency in said prize category.

2. An electronic game system according to claim 1, wherein:

the preselected indicia means comprises means for generating preselected indicia for each of two games played concurrently; and the means for comparing comprising means for comparing the random indicia to said preselected indicia for each of said games to determine the matches, if any, between said preselected indicia and said random indicia, the random indicia compared to said preselected indicia for one of said games being identical to the random indicia compared to said preselected indicia for the other of said games.

3. A gaming installation including:

(a) a central computer installation, and (b) a plurality of game terminals electrically connected to the central computer installation;

each of said terminals including value receiving input apparatus, said central computer installation being responsive to electrical value communications from the terminals to the central computer installation to calculate each prize available to a winning player at any one of said terminals and a percentage of total value from all of the terminals as a playing fee.

4. The gaming installation according to claim 3, further comprising display means electrically connected with the central computer installation to display to players prizes available to a winning player.

5. The gaming installation according to claim 3, wherein the central computer installation calculates each prize available to a winning player as a percentage of total value received at the value receiving input apparatus of all of said terminals less the value of previously distributed prizes.

6. The gaming installation according to claim 5, wherein the central computer installation further comprises a source of unpredictable indicia chosen from a group of preestablished indicia, and a win decision maker responsive to generation of indicia by the source of unpredictable indicia to determine whether a predetermined winning group of indicia has been generated.

7. The gaming installation according to claim 6, wherein the central computer installation is responsive to a signal from at least one of the game terminals to activate the source of unpredictable indicia.

8. The gaming installation according to claim 7, wherein the win decision maker comprises comparison means for comparing each generation of indicia by the source of unpredictable indicia with a preselected set of winning indicia.

9. The gaming installation according to claim 8, wherein each game terminal transmits to the central computer installation a play signal each time a player activates the game terminal, whereby each play at a game terminal results in the unpredictable generation of indicia and comparison of those indicia with the preselected indicia.

10. A gaming installation including:

(a) a central computer installation, and (b) a plurality of game terminals electrically connected to the central computer installation, said central computer installation having means for calculating a first percentage of sums deposited in the plurality of game terminals for use as at least one prize available to players at the plurality of gaming terminals and means for calculating a further percentage of sums deposited in the plurality of game terminals, as a fee to be retained by a gaming establishment, said further percentage and all prizes available to players, including the first percentage, equaling at least the entire amount of sums deposited in the plurality of game terminals.

11. The gaming installation according to claim 10, wherein a portion of the first percentage is assigned to an initial prize category usable as a prize upon depletion of the first percentage by a winning play.

12. The gaming installation according to claim 10, further comprising an unpredictable indicia source for determining indicia to be displayed at the game terminals, and means for determining when the unpredictable indicia are in a predetermined winning relation to a further set of indicia.

13. The gaming installation according to claim 12, wherein the unpredictable indicia source includes a random number generator.

14. The gaming installation according to claim 12, wherein the predetermined winning relation comprises a match between at least some of the indicia provided by the unpredictable indicia source and at least some of the further set of indicia.

15. The gaming installation according to claim 14, wherein at least one of the game terminals has an input device for use by a player to select the further indicia.

16. The gaming installation according to claim 14, wherein the further indicia are a preselected set of indicia stored in the gaming installation.

17. The gaming installation according to claim 10, wherein the unpredictable indicia source is situate in the central computer installation, and the central computer installation includes means for communicating indicia provided by the unpredictable indicia source to the game terminals.

18. The gaming installation according to claim 17, wherein the game terminals include means for activating a game play, means for electrically communicating the activation of a game play to the central computer installation, the central computer installation activating the unpredictable indicia source responsive to the receipt of the electrical communication of the activation of a game play.

19. In a single gaming establishment, a computer video game system comprising:

(a) a plurality of gaming terminals including:

(i) a display, (ii) a value receiving device, and (iii) communication circuitry, (b) a central computer installation including:

(i) an unpredictable indicia generator, (ii) a comparing arrangement for comparing indicia, (iii) communication circuitry connected in communication with the communication circuitry of the gaming terminals, and (iv) an accounting arrangement including computational means for determining a fractional part of value communicated by the gaming terminals to the central computer installation as at least one available prize and the remaining fractional part of the value communicated by the gaming terminals to the central computer installation as a fee charged for playing the game, and (c) preselected indicia providing means in one of the plurality of gaming terminals and central computer for comparison with unpredictable indicia from the unpredictable indicia generator by the comparing arrangement.

20. In a gaming establishment, a method of operating a game including the steps of:

(a) providing a central computer installation, (b) providing a plurality of game terminals, (c) receiving wagered sums at the plurality of game terminals, (d) unpredictably generating a set of indicia, (e) displaying the set of indicia unpredictably generated, (f) determining if the indicia unpredictably generated establish a win, (g) communicating the amount of sums wagered at the plurality of game terminals to the central computer installation, (h) at the central computer installation tallying sums wagered at all of the game terminals, (i) allocating a percentage of all of the sums wagered at all of the game terminals as at least one prize, and (j) allocating a percentage of all of the sums wagered at all of the game terminals as a proprietor's fee.

21. The method of operating a game according to claim 20, wherein during the course of operation of the game the percentage allocated as at least one prize and the percentage allocated as a proprietor's fee total at least 100% of the sums wagered at the terminals.

22. The method of operating a game according to claim 21, wherein step (f) comprises electronically comparing a further set of indicia establishing a win with the unpredictably generated indicia at the central computer installation.

23. The method of operating a game according to claim 22, further comprising the step of communicating a winning indicia comparison from the central computer installation to a winning game terminal.

24. The method of operating a game according to claim 22, further comprising providing a fixed set of winning indicia prior to any unpredictable generation of indicia.

25. The method of operating a game according to claim 20, further comprising displaying the amount of an available prize to players at the game terminals.

26. The method of operating a game according to claim 20, wherein sets of indicia unpredictably generated are displayed at the game terminals as symbols on reels rotated to a rest position.

27. The method of operating a game according to claim 20, wherein step (g) comprises sending a value representative signal to the central computer installation from a game terminal when a wager is made at that game terminal.

28. The method of operating a game according to claim 27, wherein step (i) comprises apportioning, at the central computer installation, each of the values represented by the value representative signal according to the percentages allocated to the at least one prize and to the fee.

29. The method of operating a game according to claim 20, wherein step (f) includes providing indicia to the central computer installation from at least one of the game terminals and comparing the provided indicia to the set of indicia unpredictably generated.

30. The method of operating a game according to claim 29, wherein the indicia provided to the central computer from the at least one of the game terminals are indicia selected by a player at said at least one of the game terminals.

31. The method of operating a game according to claim 20, wherein the step (f) includes providing indicia representative of a card hand to be beaten by a player.

* * * * *